United States Patent [19]

Stout

[11] Patent Number: 4,471,575

[45] Date of Patent: Sep. 18, 1984

[54] DOOR CLOSER

[76] Inventor: Gerald T. Stout, 16390 Glenbrae La., Meadow Vista, Calif. 95722

[21] Appl. No.: 453,622

[22] Filed: Dec. 27, 1982

[51] Int. Cl.[3] ..... E05D 15/06; E05F 1/08

[52] U.S. Cl. ..... 49/404; 16/80

[58] Field of Search ..... 49/404; 16/71, 80, 72

[56] References Cited

U.S. PATENT DOCUMENTS

| | | | |
|---|---|---|---|
| 1,515,155 | 11/1924 | Meagher | 16/71 |
| 2,593,403 | 4/1952 | Bailey | 49/387 |
| 3,398,424 | 8/1968 | Nieman | 16/80 |
| 3,561,161 | 2/1971 | Green | 16/80 |
| 3,887,962 | 6/1975 | Mills | 16/72 |
| 4,003,102 | 1/1977 | Hawks et al. | 49/404 X |
| 4,004,372 | 1/1977 | Beard et al. | 16/72 X |
| 4,126,912 | 11/1978 | Johnson | 16/81 |
| 4;301,623 | 11/1981 | Demukai | 49/404 |

*Primary Examiner*—Philip C. Kannan

*Attorney, Agent, or Firm*—Leonard Bloom

[57] ABSTRACT

An externally mounted device for automatically closing sliding panels such as screen door panels with a spring and a pneumatic cylinder mounted between the frame surrounding the panel and a pivot arm with a wheel which rides within a track installed on the panel itself, so that opening the panel extends the spring, biasing the pivot arm and the panel associated therewith towards the closed position. Upon release of the panel the pneumatic cylinder controls the rate at which the panel closes.

10 Claims, 3 Drawing Figures

DOOR CLOSER

BACKGROUND OF THE INVENTION

This invention relates generally to automatic door closing devices, and more specifically to a device designed to close sliding doors and screens.

With the increased use of sliding doors and screens in both commercial and residential buildings, the problem exists in maintaining these sliding doors and screens in a closed position when not in use to prevent any loss of energy associated with heating or cooling and to prevent any flying or crawling pests from entering the interior space of the building.

This problem is particularly prevalent in the domestic environment where sliding doors and screens are often utilized to provide access to porches, decks, backyards, patios, and pools. During the summer months when family activities are centered around those loci there is a constant flow of human traffic, especially when there are children involved, through these sliding doors and screens. It often occurs that children and adults leave these doors and screens open when entering or leaving the domicile either due to neglect or the necessity of the moment as when one's hands are full and closing the door would be quite awkward.

Various devices exist in the prior art which attempt to address themselves to these goals, and the state of the art of which the applicant is aware comprises the following U.S. Pat. Nos. 2,593,403—Bailey; 4,003,102—Hawks et al.; 4,126,912—Johnson; 4,301,623—Demukai.

None of these references contemplate singly nor render obvious in combination that which is taught and claimed in the instant application, since the patent to Demukai, Johnson, and Hawks et al. all teach the use of internally mounted springs, cables and pulleys which are integral with the door member itself and are incapable of being retrofitted without replacement of the entire door assembly. While each of the references teaches the use of a semi-automatic sliding door device with a tensioning spring or the like, none of the devices teach the use of a spring and air cylinder disposed at an angle relative to the direction of travel of the door, and further none has an arm which swings from a first to a second position, the arm having a roller disposed in a track. For example, the patent to Demukai teaches the use of a sliding door device with tension springs wherein a door is literally translated against spring tension 7 so that when the force used to open the door has been released, the spring will cause the door to move back to its closed position. See FIG. 1 for example. Similarly, the patent to Bailey teaches the use of a counter-balanced weight which causes the door to go from a first to a second position due to the work done by lifting the weight. Hawks et al. teaches the use of a spring or gravity motor having an override mechanism for a movable window or door including a pneumatic cylinder, a piston, a check valve admitting air to the cylinder, an override valve for permitting pressure damping of the air in the cylinder during movement of the door or window at a speed greater than the normal closing speed by the motor. That which is taught in the instant application is distinguished in that it is installed on the exterior surfaces of preexisting doors and screens, thus can be easily maintained and retrofitted to any existing sliding door or screen. Furthermore, the mechanical structure taught in the instant application is neither contemplated nor rendered obvious by any of the teachings in the citations.

Similarly the patent to Bailey teaches the use of a complex system of cables, pulleys and springs adapted to be use in a heavy duty commercial setting such as a mine, which does not fall within the purview of the instant application which is directed toward providing a simple and easily retrofitted automatic closing device for sliding doors and screens.

SUMMARY AND OBJECTS OF THE INVENTION

Accordingly, it is a primary object of the present invention to provide an automatic and controlled closing device for sliding doors and screens which is easily installed by the consumer and readily retrofitted to various styles of commercially available sliding doors and screens.

It is a further object of the present invention to provide an automatic and controlled closing device for sliding doors and screens which is installed on external surfaces of the door assembly thereby providing easy access to any of the components for possible maintenance or replacement. Thus any repairs would not involve the costly process of disassembling the entire assembly to gain access to the components of the device.

It is another object of the present invention to provide an automatic and controlled closing device for sliding doors and screens which provides a steady controlled closing of the door or screen thereby preventing any accidents that could result from a sudden movement of the door from an open to a closed position.

It is a still further object of the present invention to provide an automatic and controlled closing device for sliding doors and screens which can be locked in an open position if so desired.

It is still another object of the present invention to provide an automatic and controlled closing device for sliding doors and screens which can be mounted either on the inside or outside of the door or screen according to the requirements of the site.

It is a still further object of the present invention to provide an automatic and controlled closing device for sliding doors and screens which can be installed either on the left panel or the right panel of a sliding door or screen according to the requirements of the situation.

It is a still further object of the present invention to provide an automatic and controlled closing device for sliding doors and screens which is light weight, simple to install, inexpensive and lends itself well to mass production techniques.

These and other objects will be made manifest in light of the following specfication and in conjuction with the appended drawing figures.

BRIEF DESCRIPTION OF THE DRAWING FIGURES

DESCRIPTION OF THE PREFERRED EMBODIMENT

Figure 1:
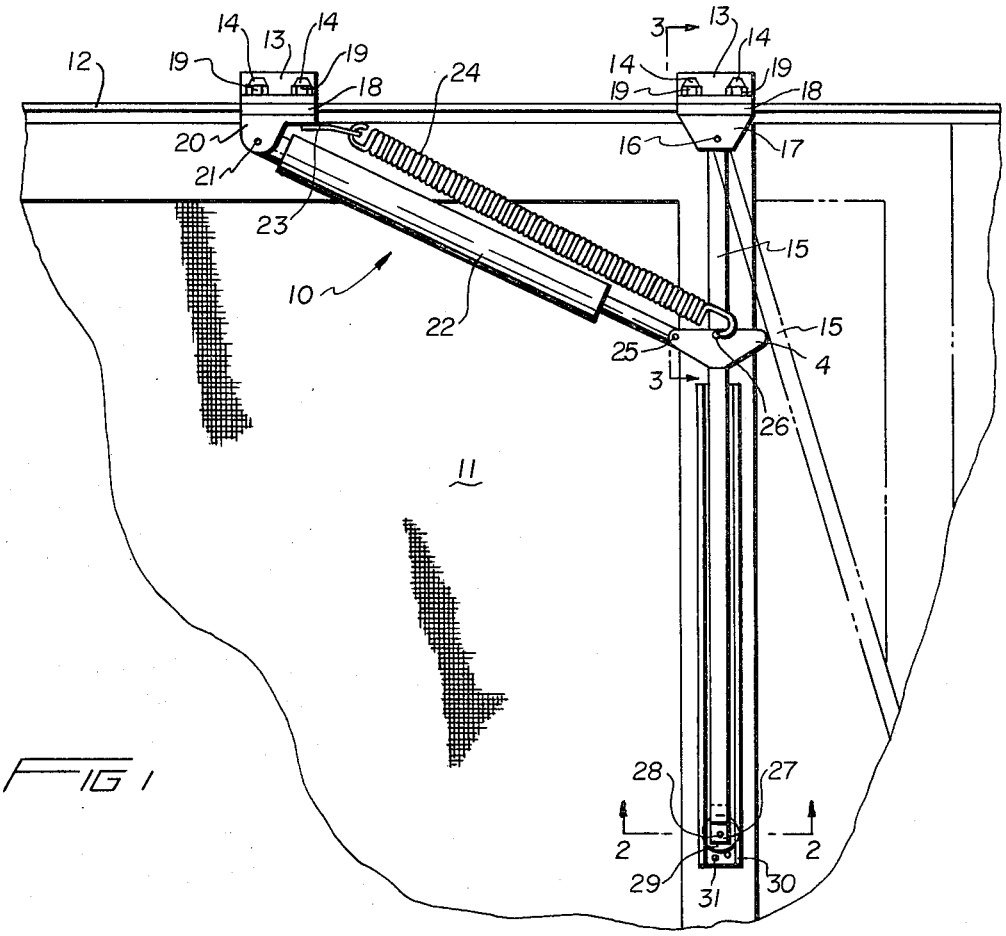
FIG. 1 is a front view of the device according to the instant application as it would appear mounted on a sliding screen, the portion in phantom showing a second position of the door and the deployment of the instant device.

Referring now to the drawings in detail wherein like reference numerals represent like parts throughout the several figures, reference numeral 10 refers generally to the device according to the instant application, which is applied to a sliding panel 11, as shown in FIG. 1.

The sliding panel 11 may be a door, a window, or the like, that moves horizontally to open and close. In a preferred embodiment, the closing device 10 is applied to a screen door panel. The panel 11 is surrounded by and rides in a frame 12 that allows the panel 11 to translate horizontally from an open to a closed position as shown in phantom in FIG. 1.

Figure 3:
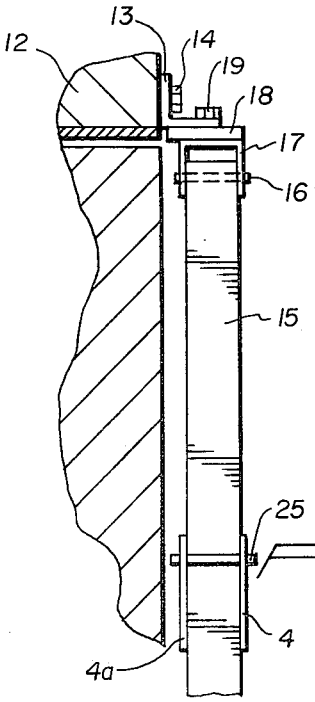
FIG. 3 is a sectional view of that which is shown in FIG. 1 taken along lines 3—3.

The components of the panel closing device 10 depend from two L-shaped or flate plate flush mounting brackets 13 affixed to the frame 12 by screws 14. As shown in FIG. 3, the mounting bracket 13 supports from a bottom surface thereof a medial bar piece 18 and a C-shaped axle housing 17 which are bolted to the bracket 13 by means of bolts 19. The axle housing 17 pivotally supports a pivot arm 15 which rides upon an axle 16, thereby allowing the pivot arm arcuate motion in substantially the same direction as the panel 11.

Similarly, the other L-shaped mounting bracket 13 supports a medial bar 18 and a second axle housing 20 by means of bolts 19. The second axle housing 20 is provided with a transversely mounted offset axle 21 which pivotally secures an upper end of a pneumatic cylinder 22. The axle housing 20 is further provided with a mounting tab 23 which engages the upper end of a return spring 24. Mounting plates 4 are fixed to a front and rear surface of the pivot arm 15 at an upper medial portion thereof. The mounting plates 4 have fixed therebetween an axle 25 which pivotally engages the lower end of the pneumatic cylinder 22. The forward most mounting plate **4*a* is further provided with an orifice 26 to engage the lower end of the return spring 24**.

Figure 2:
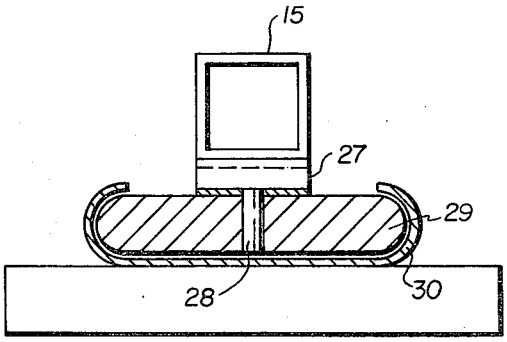
FIG. 2 is a section view of that which is shown in FIG. 1 taken along lines 2—2.

As shown in FIG. 2, a bottom end of the pivot arm 15 is provided with an offset plate 27 which has depending therefrom and supporting thereto an axle 28 and a wheel 29. The wheel 29 rides within and is constrained by a C-shaped track 30 which is mounted substantially vertically and proximate to an edge of the sliding panel 11. The track 30 is attached to the panel 11 by means of screws 31, as shown in FIG. 1.

In use and operation, when the panel 11 is directed from a first position to a second position as shown in phantom in FIG. 1, the pivot arm 15 is rotated from a substantially vertical position as the wheel 29 rises in the track 30 and the pneumatic cylinder 22 telescopes outwardly capturing air therein and the return spring 24 is extended thereby biasing against the pivot arm 15 in a direction which closes the panel when the panel is released due to the force applied to the channel by the biased pivot arm. Controlled release of the air captured within the pneumatic cylinder 22 causes the panel to slide to a closed position in a substantially gentle manner thereby preventing any acceleration of the panel as it returns to a closed position.

Having thus described the preferred embodiment of the invention, it should be understood that numerous structural modifications and adaptations may be resorted to without departing from the spirit of the invention.

What is claimed is:

1. An automatic closing device for a sliding panel comprising, in combination:

a first mounting bracket mounted proximate to and above said sliding panel on a medial portion of a frame surrounding said panel, a second mounting bracket on said frame proximate to and above an inner vertical edge of said sliding panel when in one extreme position and distanced from said first mounting bracket, an arm pivotally mounted at an upper end to said second mounting bracket and depending substantially vertically therefrom, said arm fixedly provided on a front and rear surface of an upper medial portion thereof with a pair of mounting plates, said arm further provided on a back surface of a lower end thereof with a guide wheel, a track affixed substantially vertically to a front surface of said sliding panel proximate to said vertical edge of said panel and proximate to said arm, said track slidably receives said guide wheel of said arm so that horizontal motion of said sliding panel causes said arm to pivot about said second mounting bracket and said guide wheel to rise and fall within the confines of said track, a return spring mounted between said first mounting bracket and said mounting plates on said arm, whereby horizontal motion of said panel from a first position to a second position away from said first mounting bracket extends said spring which biases said arm and said panel operatively associated therewith toward said first position, and a pneumatic cylinder pivotally mounted between said first mounting bracket and said mounting plates on said arm so that horizontal motion of said panel from said first to said second position extends said pneumatic cylinder capturing air therein, the relatively slow release of air from said pneumatic cylinder resists and retards the closing motion of said panel due to the bias of said spring, whereby said panel closes at a relatively slow and controlled rate.

2. The device of claim 1 wherein said track is substantially C-shaped and said guide wheel slidably fixed therewithin is confined to vertical motion thereby.

3. The device of claim 2 wherein said guide wheel is mounted on an axle normal to an extension piece depending from said back surface of said arm and at said lower end thereof.

4. The device of claim 3 wherein said mounting plates have an axle extending therebetween to pivotally mount a lower end of said pneumatic cylinder.

5. The device of claim 4 wherein one plate of said pair of said mounting plates has on an upper medial portion thereof distanced from said axle, an orifice therethrough to engage the lower end of said spring.

6. The device of claim 5 wherein said first mounting bracket is substantially L-shaped and has depending from a bottom surface thereof a first axle housing containing a transversely mounted axle which engages an upper end of said pneumatic cylinder.

7. The device of claim 6 wherein said first axle housing has a mounting tab extending towards said first mounting bracket to engage the upper end of said spring.

8. The device of claim 7 wherein said second mounting bracket is substantially L-shaped and has depending therefrom a second axle housing containing a transversely mounted axle which engages said upper end of said arm.

9. The device of claim 8 wherein said first mounting bracket and said first axle housing, said pneumatic cylinder and said spring associated therewith are mounted such that said spring and said pneumatic cylinder are substantially parallel and coextensive during all positions of travel of said sliding panel.

10. The device of claim 9 wherein said mounting plates are of substantially triangular configuration having an axis of symmetry coincident with said arm when said sliding panel is in said first position, said mounting plates disposed just above said track, said pneumatic cylinder connected to an apex of said triangular plate, said spring attached at the axis of symmetry.

* * * * *